US005159868A

United States Patent [19]

Thomas et al.

[11] Patent Number: 5,159,868

[45] Date of Patent: Nov. 3, 1992

[54] KNIFE CYLINDER FOR PROCESSING WEBLIKE MATERIAL

[75] Inventors: Hermann Thomas, Darmstadt; Josef Herd, Munster, both of Fed. Rep. of Germany

[73] Assignee: Maschinenfabrik Goebel GmbH, Darmstadt, Fed. Rep. of Germany

[21] Appl. No.: 689,823

[22] PCT Filed: Oct. 8, 1990

[86] PCT No.: PCT/DE90/00760

§ 371 Date: May 29, 1991

§ 102(e) Date: May 29, 1991

[87] PCT Pub. No.: WO91/05641

PCT Pub. Date: May 2, 1991

[30] Foreign Application Priority Data

Oct. 17, 1989 [DE] Fed. Rep. of Germany ..... 3934525

[51] Int. Cl.[5] ..... B26D 7/26

[52] U.S. Cl. ..... 83/674; 83/346; 83/698

[58] Field of Search ..... 83/698, 674, 346, 699, 83/700, 343

[56] References Cited

U.S. PATENT DOCUMENTS

| | | | |
|---|---|---|---|
| 3,769,868 | 11/1973 | Hornung | 83/348 |
| 4,131,047 | 12/1978 | Schriber et al. | 83/698 |
| 4,594,928 | 6/1986 | Thomas et al. | 83/698 |
| 4,671,154 | 6/1987 | Thomas et al. | 83/698 |
| 4,715,250 | 12/1987 | Rosemann | 83/674 X |

FOREIGN PATENT DOCUMENTS

| | | |
|---|---|---|
| 0196688 | 10/1986 | European Pat. Off. . |
| 8712804 | 1/1988 | Fed. Rep. of Germany . |

*Primary Examiner*—Frank T. Yost
*Assistant Examiner*—Eugenia A. Jones
*Attorney, Agent, or Firm*—Watson, Cole, Grindle & Watson

[57] ABSTRACT

A knife cylinder for processing weblike material has at least one slot in its cylindrical surface for receiving a web cutting/perforating knife retained in place by a plurality of pressure medium cylinders distributed over the length of the knife. A rigid wall within the slot limits the extent of the pressure cylinders, and push rods extending through the wall may be provided for transferring pressure from the pressure cylinders to the knife.

4 Claims, 2 Drawing Sheets

KNIFE CYLINDER FOR PROCESSING WEBLIKE MATERIAL

This invention relates to a cutting or knife cylinder for processing weblike material, such as paper, plastic sheets or metal foils, fabric or the like, having at least one slot formed in the cutting cylinder and lying parallel to the rotational axis of the cutting cylinder on its circumference and provided to receive and attach a knife arranged substantially parallel to the rotational axis of the cutting cylinder; pressure points are distributed over the length of each knife to clamp the respective knife with respect to the cutting cylinder by means of several pressure medium cylinders, pressing the respective knife against the cutting cylinder and distributed over the length of each knife, pressure conduit system is connected to the pressure medium cylinders and revolves with the cutting cylinder, for each knife at least one shim is arranged between that knife and associated pressure medium cylinder. The pressure medium cylinders assigned to each slot are arranged both within the slot and also substantially in the circumferential direction of the cutting cylinder, and the pressure medium cylinders are bellows cylinders made preferably of metal.

Cutting cylinders of the aforementioned type are used in machines to produce cuts in weblike materials. These cuts can be produced with knives which do not have a continuous cutting edge so that in the manner a perforation is generated. However, the knives can also have a continuous cutting edge. Thus, it is possible to cut off sheets of specific length from a continuous web or to deposit this web into accordion-like folded stacks. The cutting or cut lines formed in the webs are usually aligned at right angles to the grain direction of the web to be processed. The knives required for this purpose are usually inserted into a revolving cutting or knife cylinder in such a manner that knives that have become dull can be exchanged without the entire cylinder having to be removed from the respective processing machine, for example a form printing machine. At least one knife is attached to each cutting cylinder. However, to form cross perforations, which are to exhibit a shorter distance between one another than corresponds to the diameter or circumference of the cutting cylinder, several knives, for example, two, three, six or eight knives are distributed regularly or irregularly on the circumference of the cutting cylinder.

So that the knives can be effective in the desired manner, they must be adjusted relative to the web to be processed or to pressure cylinder interacting with the cutting cylinder. For this purpose, the knives are usually attached force-lockingly to the cutting cylinders or within the cutting cylinder. If the knives have become blunt in the course of their use, they have to be exchanged for new knives. However, an exchange of knives usually requires as a rule that both the cutter, in which the respective knife is installed, and another machine that eventually works together with the cutter, for example, a form printing machine, must be stopped. Stopping the machine automatically causes loss in production, which is as high as corresponds to the time in which the machines must be stopped. Therefore, one endeavors to perform the exchange of the knives, consuming as little time as possible.

A device of the aforementioned type is known, for example, from U.S. Pat. No. 4,671,154, for which reason reference is made herein to this patent in order to support the description of the present patent application. The device described here can, however, be further simplified in its construction, from which it follows as the object of the present invention to improve the construction known from prior art in such a manner that its operation is even further simplified.

SUMMARY OF THE INVENTION

The aforementioned problem is solved by a device formed in the cutting cylinder to limit the extent of each of the pressure medium cylinders, this limiting device being arranged within the respective slot and between the respective pressure medium cylinders and the respective knife. The limiting device can be in the form of a strip-like bar such that the strip-like bar can be made integral with and the cutting cylinder. In addition, the strip-like bar can be provided with through holes, where the reciprocal distances of the holes correspond to the reciprocal distances of the respective pressure medium cylinders. Furthermore, push rods arranged between each pressure medium cylinder and the shim of the respective knife, such that each push rod can be guided by the strip-like bar.

A bore, aligned at right angles to the base of the respective slot, can be formed in each of the shims under, and the inner diameter of the bore is greater than the outer diameter of a screw fastener extending through such bore.

The pressure medium can be fed to each pressure medium cylinder through a conduit, which is formed in the cutting cylinder parallel to the respective slot. In so doing it must be taken into consideration that all components of the present device are tuned and dimensioned according to function. Owing to the present solution it is possible to initiate the forces induced by the pressure medium cylinders causing the clamping of the knives without the pressure medium cylinders expanding excessively. In addition, the result is a simpler assembly, since the push rods can be readily inserted into the lift limiter designed as the strip-like bar. In addition, the pressure medium cylinders can be easily located in the respective slot and connected there to a single screw in such a manner that a good seal is produced relative to the conduit system feeding the pressure medium due to the simple sealing surfaces. In addition, the shim assigned to each knife is not severely stressed in an undesired manner by the centrifugal force even if, for example, due to an operating error a knife or a substitute for a knife should be missing in the event for the case that at the point reserved for the knife the web is not to be perforated or cut.

Other features and advantages follow from the following description of an of the invention. The individual features can be realized one by one individually or several features in any combination can be realized into embodiments of the invention. The invention will now be explained in detail with the aid of an embodiment that does not restrict the inventive idea and is shown schematically in the accompanying drawings. The embodiment can be modified in different ways within the scope defined by the basic idea. In this respect, nonessential machine parts that are adequately known to the expert are not shown in the drawings for the sake of greater clarity. But rather the drawings show only those parts that are necessary to explain the invention in detail and its advantages.

BRIEF DESCRIPTION OF THE INVENTION

DETAILED DESCRIPTION OF THE INVENTION

Figure 1:
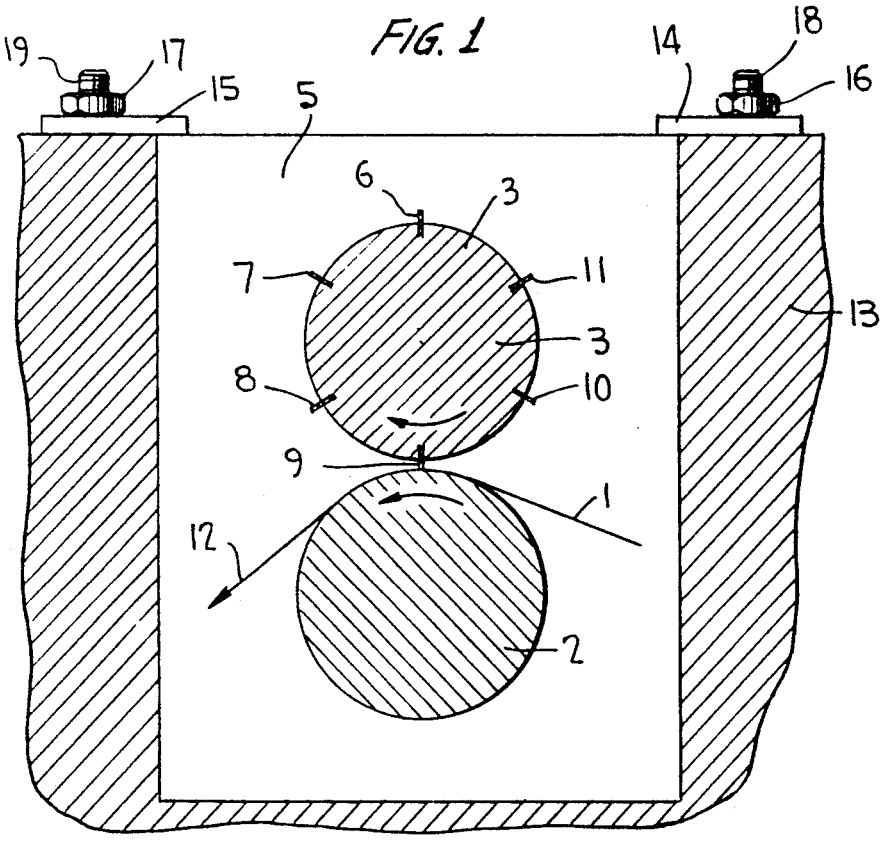
FIG. 1 is a schematic view of the cutting or perforating assembly, shown in part as a cross sectional view.

A web 1 of paper, plastic, metal, film, fabric or the like extends partially about a pressure cylinder 2. Simultaneously web 1 passes through a roller gap, which is formed by pressure cylinder 2 a cutting cylinder 3. Pressure cylinder 2 and cutting cylinder 3 can be rotated with the aid of a corresponding bearing 4 in a machine frame 5. At least one of the two cylinders 2 or 3 is driven, but it is also possible that both cylinders be connected together by gear wheels, gear belts or the like so that they can revolve in exact phase relation to each other. Thus it is only necessary to drive one of the two cylinders, since the other is also driven by the synchronizing device comprising gear wheels, gear belts or the like.

Cutting cylinder 3 has knives or knife positions 6, 7, 8, 9, 10, and 11. The knives located at positions 6 to 11 extend substantially in the direction of the geometric axis of cutting cylinder 3 and are attached in the cutting cylinder 3 parallel to or slightly sloped relative to this axis. The related knives can have a continuous cutting edge or a cutting edge interrupted by transverse grooves. If the knives have a continuous cutting edge, web 1 is traversely cut into single sheets when the web flows through the roller gap formed by cylinders 2 and 3.

If the knife cutting edges are interrupted by tranverse grooves, web 1 is not totally severed at right angles to its formation direction. Rather the result is a plurality of spaced cuts in web 1, connected by connecting ties. In this manner web 1 is perforated at right angles to its formation direction indicated by arrow 12. Due to this perforation it is possible to tear individual sheets from web 1 in one later operation. However, it is also possible, for example, that those points at which web 1 is weakened by perforations extending at right angles the web 1 can be folded at right angles to its formation direction during a later accordion folding operation.

FIG. 1 shows one example of a cutting cylinder 3, on the circumference which six knives are distributed uniformly. In contrast, it is also possible to design the cutting cylinder 3 in such a manner that one, two, three, four, five, seven, eight or ten knives or however a different number of knives can also be attached uniformly distributed on the circumference of the cutting cylinder. Corresponding to the number and positions of provided knives, there are also a number of open slots serving to attach each of the knives to the cutting cylinder. In addition, however, it is also possible to form a specific number of slots into cutting cylinder 3, but in the respective production operation, on the other hand, to use less than all of these slots or the knives depending on the particular requirement of the production to be targeted and to insert ineffective, optionally socalled dummy knives at the nonused positions.

Cutting cylinder 3 and pressure cylinder 2 are attached and can be rotated in such a manner in machine frame 5 that these machine parts form a subassembly, which can be removed as a whole from main frame 13 of the machine and can be exchanged for another similar subassembly. To this end, it is necessary to attach machine frame 5 in main frame 13 by means of clamping shoes 14 and 15, nuts 16 and 17 and tie rods 18 and 19, screwed into main frame 13, for the period of the machine time. In contrast, it is, however, also possible to omit machine frame 5 and related fasteners and to position cutting cylinder 3 and pressure cylinder 2 directly in the main frame 13 of the machine.

Figure 2:
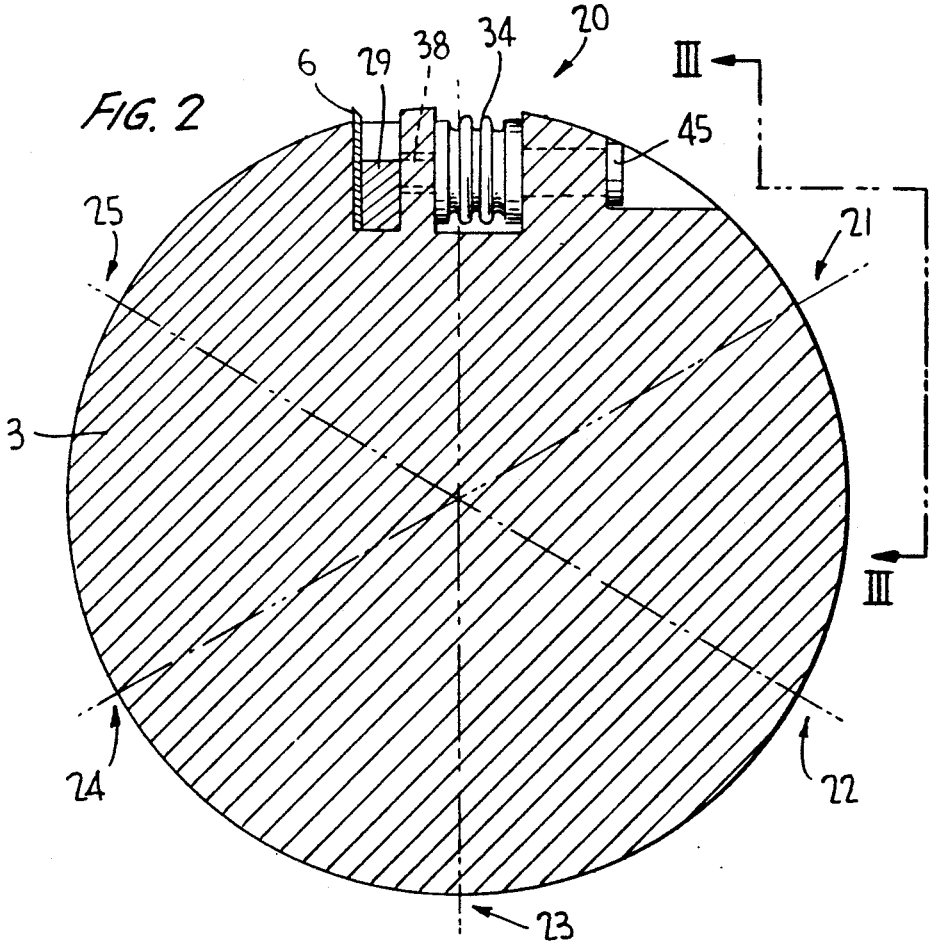
FIG. 2 is a cross sectional view of the cutting or knife cylinder taken along line II—II of FIG. 3 at an enlarged scale.
Figure 3:
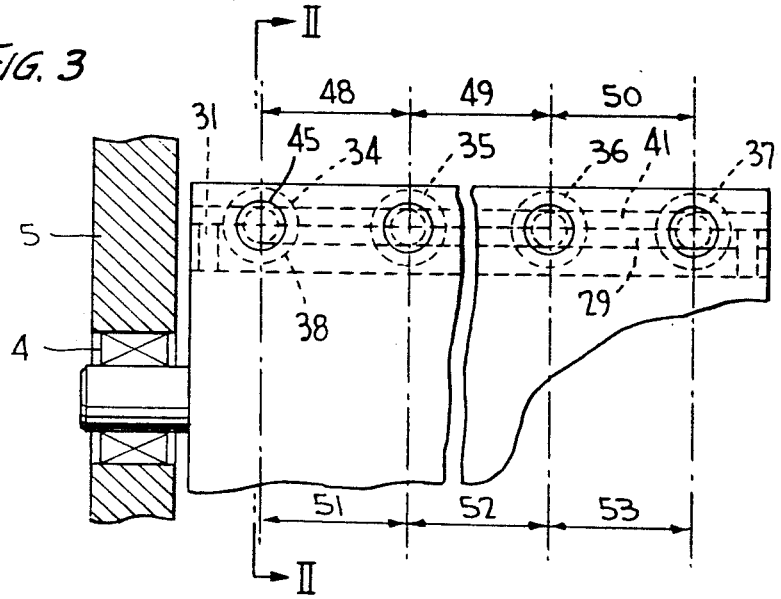
FIG. 3 is a partial sectional view taken in the direction of III in arrow FIG. 2.

It is apparent from FIG. 2 that slots 20, 21, 22, 23, 24, and 25 representing, for example, six knife positions are formed in cutting cylinder 3. The first of these slots 20 is shown in detail, whereas the remaining identical slots 21-25 are indicated merely with a dash-dotted straight line in the interest of clarity. Each of the slots has a side wall 26, which represents within cylinder 3 a surface extending substantially radial to said cylinder. Extending parallel to each side wall 26, each slot has a second side wall 27, which is also formed in cutting cylinder 3.

Base 28 of each slot with its portions 28*a* and 28*b* extends perpendicular to the first side wall 26 and to the second side wall 27. Each slot thus has three surfaces 26, 27, and 28. Each slot is open in the radial direction outwardly of cutting cylinder 3. Into each slot a shim 29 is inserted in such a manner that base 30 of shim 29 abuts portion 28*a* of the base of the slot. Each shim 29 has at least one bore 31, through which a screw fastener 32 is extended. Bore 31 of shim 29 has preferably a larger diameter than the outer diameter of screw 32. Screw 32 is screwed into a thread 33, which is formed in cutting cylinder 3 such that the geometric axis of screw 32 is perpendicular to the geometric axes of pressure medium cylinders 34, 35, 36 and 37, i.e., also relative to the base 28 of slot 20.

Figure 4:
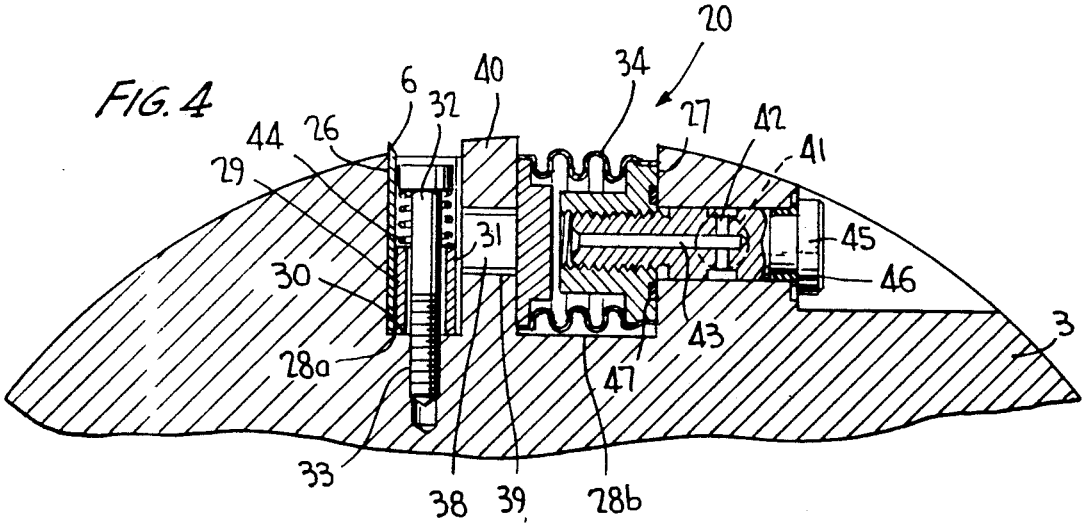
FIG. 4 shows a detail of FIG. 2 on a different scale and shows a screw in a sectional plane.

The pressure medium cylinders are preferably bellows cylinders made of metal. Knife 6 located in knife position 6 is pressed, for example, against side wall 26 of slot 20 with the aid of pressure medium cylinder 34 with the insertion of shim 29 and a strong, rigid push rod 38. Push rod 38 is guided in a through hole or perforation 39 formed in, a strip-like bar 40 attached in slot 20. This strip-like bar can be attached to cutting cylinder 3, for example, at the base of slot 20 and thus abut the base 28 of slot 20. Preferably, however, bar 40 is made of the same component as cutting cylinder 3, i.e., it is machined out of the material of cutting cylinder 3. Since pressure medium from the channels 41, 42 and 43 is fed to pressure medium cylinder 34, a force is generated that moves the push rod 38 to the left in FIG. 4, thus moving shim 29 with respect to screw 32 as far as the difference between the diameter of the bore 31 and the outer diameter of the screw 32 allows and pushes knife 6 against cutting cylinder 3 from the right in FIG. 4 and clamps with said cutting cylinder force-lockingly. In addition, since a pressure spring 44 is provided between the head of screw 32 and shim 29, a movement of shim 29 with respect to screw 32 is permitted.

Conduits 42 and 43 are formed in worked into a screw 45, which is provided with a seal 46. Similarly pressure medium cylinder 34 is provided with a seal 47. When all dimensions are suitably chosen, bar 40 limits the expansion or extent of cylinder 34, a feature that has, however, no negative effect on the hold of knife 6, since between cylinder 34 and knife 6 is inserted push rod 38, which is somewhat longer than the width of bar 40 visible in FIG. 4 so that adequate freedom of movement remains for the pressure medium cylinder in order to clamp or release knife 6. Whatever force applies to pressure medium cylinder 34 also applies in an analogous manner to all pressure medium cylinders inserted into cutting cylinder 3, for example to the other pressure medium cylinders 35, 36 and 37, which are distributed over the length of knife 6 and the length of all other knives. Pressure medium cylinders 34 and 35 maintain, for example, a distance 48 between each other; pressure medium cylinders 35 and 36, distance 49; and pressure medium cylinders 36 and 37, distance 50. The corresponding, related holes, as indicated, for example, by hole 39, maintain distances 51, 52, and 53 among each other in such a manner that each perforation is arranged concentrically to the respective pressure medium cylinder. The respective push rod such as push rod 38 lies in the same line of action. Thus, each push rod is guided by means of the strip-like bar 40, since each push rod is located in a corresponding recess of this bar and is enclosed by the bar with adequately large clearance for its movement. Thus bar 40 divides slot 20 into two subslots with bases 28*a* and 28*b*, where bar 40 penetrates preferably the total axial length of cylinder 3. Its surfaces shown in FIG. 4 as vertical edges extend parallel to the side walls 26 and 27 of slot 20. The same applies to all other slots provided for the accommodation of the knives and belonging to cutting cylinder 3. Conduit 41 is formed in cutting cylinder 3 parallel to the respective slot. It intersects those bores through which screw 45 or other analogous screws extend so that the result is an integrated conduit system at least per slot or with the aid of suitable pipe lines. The respective conduit system is connected in turn to a pressure generator (not shown).

Parts List

1 web
2 pressure cylinder
3 cutting cylinder
4 bearing
5 machine frame
6 knife (position)
7 knife (position)
8 knife (position)
9 knife (position)
10 knife (position)
11 knife (position)
12 arrow
13 main frame
14 clamping shoe
15 clamping shoe
16 nut
17 nut
18 tie rod
19 tie rod
20 slot
21 slot
22 slot
23 slot
24 slot
25 slot
26 side wall
27 side wall
28 base
29 shim
30 base
31 bore
32 screw
33 thread
34 pressure medium cylinder
35 pressure medium cylinder
36 pressure medium cylinder
37 pressure medium cylinder
38 push rod
39 perforation
40 bar
41 channel
42 channel
43 channel
44 pressure spring
45 screw
46 seal
47 seal
48 distance
49 distance
50 distance
51 distance
52 distance
53 distance

We claim:

1. A knife cylinder for processing a continuous web, said cylinder being mounted on a frame for rotation about its axis of rotation, and comprising:

a cylindrical surface portion having at least one open slot formed therin for receiving and positioning a knife substantially parallel to said axis of rotation;

a plurality of pressure medium cylinders distributed over the length of said knife for pressing said knife against said knife cylinder, said pressure medium cylinders being located within said slot and each comprising metallic bellows cylinders;

conduit means mounted on said knife cylinder for rotation together therewith and being connected to said pressure medium cylinders for transmitting pressure medium thereto for axially extending said pressure medium cylinders in a direction perpendicular to said knife;

a plurality of shims located within said slot bearing against said knife and being respectively associated with said pressure medium cylinders;

said knife cylinder having a stationary wall lying parallel to said knife and being located within said slot between said shims and said pressure medium cylinders for limiting the axial extent of said pressure cylinders, said wall having through openings therein respectively aligned with said pressure medium cylinders, push rods located in said openings and extending at least between opposite sides of said stationary wall, said push rods transferring pressure from said pressure cylinders to said shims and to said knife for retaining said knife in place within said slot.

2. The knife cylinder according to claim 1, wherein each said shim has at least one bore therein lying parallel to said knife, a bolt fastener extending through each said bore for mounting said shims to said knife cylinder.

3. The knife cylinder according to claim 2, wherein each of said bores has a diameter greater than the diameter of each of said fasteners so as to avoid any interference by said fasteners in transferring pressure to said knife.

4. The knife cylinder according to claim 1, wherein said conduit means includes a conduit formed in said knife cylinder and lying parallel to said slot.

* * * * *